US006286233B1

(12) United States Patent
Gaither

(10) Patent No.: US 6,286,233 B1
(45) Date of Patent: Sep. 11, 2001

(54) INTERNALLY LACED SHOE

(76) Inventor: David E Gaither, 603 Willard Ave., Atlanta, GA (US) 30310

( * ) Notice: Subject to any disclaimer, the term of this patent is extended or adjusted under 35 U.S.C. 154(b) by 0 days.

(21) Appl. No.: 09/288,831

(22) Filed: Apr. 8, 1999

(51) Int. Cl.[7] ..... A43C 11/00
(52) U.S. Cl. ..... 36/50.1
(58) Field of Search ..... 36/50.1, 50.5

(56) References Cited

U.S. PATENT DOCUMENTS

| | | | |
|---|---|---|---|
| 2,038,151 | | 4/1936 | Wernmark . |
| 2,395,767 | | 2/1946 | Sutcliffe . |
| 2,590,648 | | 3/1952 | Pitz . |
| 3,793,749 | * | 2/1974 | Gertsch et al. . |
| 3,977,098 | | 8/1976 | Chalmers . |
| 4,130,949 | | 12/1978 | Seidel . |
| 4,571,856 | | 2/1986 | Lin et al. . |
| 4,654,985 | | 4/1987 | Chalmers . |
| 4,811,503 | * | 3/1989 | Iwama . |
| 4,869,000 | | 9/1989 | York, Jr. . |
| 4,937,952 | * | 7/1990 | Olivieri . |
| 5,056,241 | | 10/1991 | Young . |
| 5,205,054 | | 4/1993 | York, Jr. . |
| 5,205,055 | | 4/1993 | Harrell . |
| 5,269,078 | | 12/1993 | Cochrane . |
| 5,400,529 | | 3/1995 | Bell et al. . |
| 5,659,982 | | 8/1997 | Muraoka et al. . |
| 5,687,460 | * | 11/1997 | Foffano et al. . |
| 5,775,006 | | 7/1998 | Breuner . |
| 5,791,068 | * | 8/1998 | Bernier et al. . |
| 5,992,057 | | 11/1999 | Monti . |
| 6,052,921 | | 4/2000 | Oreck . |

* cited by examiner

*Primary Examiner*—Ted Kavanaugh
(74) *Attorney, Agent, or Firm*—Joel D. Myers; Myers & Associates, P.C.

(57) ABSTRACT

An internal lacing system for footwear wherein a plurality of lace guides having rotatable rollers are secured and strategically positioned throughout a shoe to facilitate the securing of the foot within the shoe. More specifically, an elongated lace having a first end and a second end is internally channeled through each of the lace guides and over the respective rollers, wherein the second end of the elongated lace exits the internal of the shoe at the upper portion of the shoe proximal to the shoe opening. The first end of the elongated lace is secured within the shoe proximal to the toe area of the shoe. To tighten the shoe, a user simply pulls on the exposed second end of the lace thereby allowing the lace to roll along each respective roller positioned within each lace guide. Additionally, because the first end of the lace is fixed, the pulling on the second end of the lace will result in a reciprocating force about each lace guide thus securely tightening the shoe around the user's foot.

7 Claims, 5 Drawing Sheets

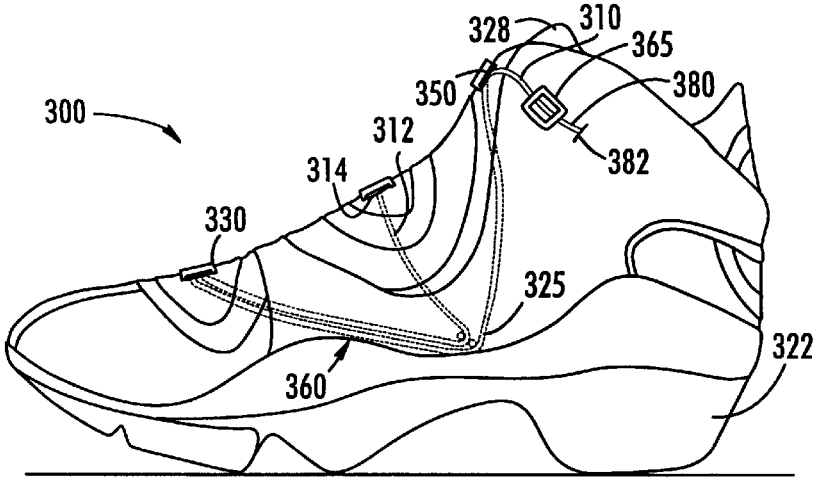
FIG. 9
FIG. 10
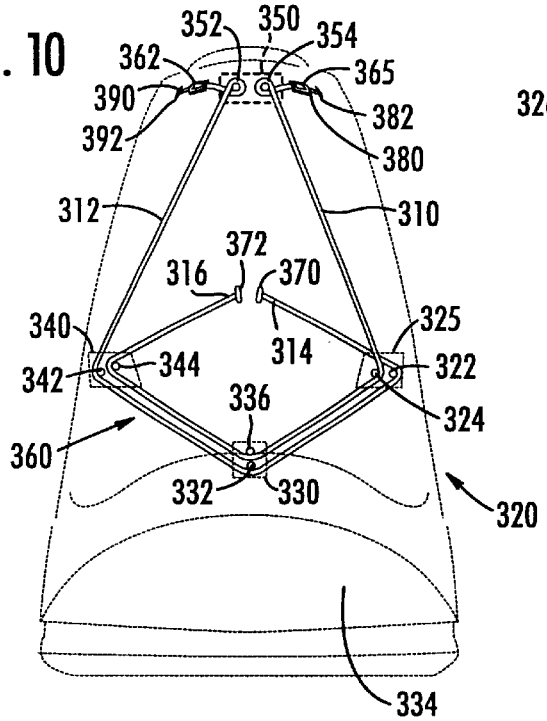
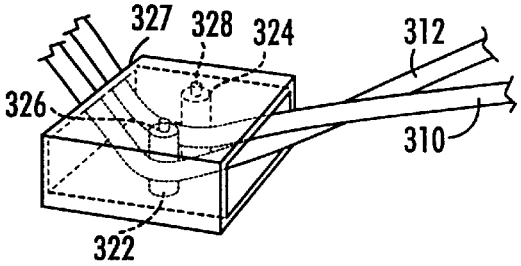
FIG. 11
FIG. 12
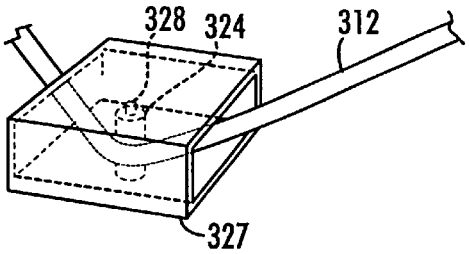

INTERNALLY LACED SHOE

TECHNICAL FIELD

The present invention relates generally to footwear and, more specifically, to an internally laced shoe.

BACKGROUND ART

There are a multitude of known shoe and lacing designs for footwear. However, these known designs are deficient in light of the present invention. For instance, previous designs fail to adequately and comfortably secure a user's foot within the shoe. Traditional shoes have an upper central exterior lacing system wherein the lacing is usually channeled through a plurality of eyelets positioned generally on both sides of the center top of the shoe and in close proximity thereto. This type of design fails to provide adequate support by limiting the securing area to generally the upper portion of the foot. For instance, in sporting applications these traditional designs may be physically dangerous and reduce the athlete's performance by allowing the foot to slide or otherwise move within the shoe during use. In addition, because the lacing in traditional designs are exterior, undesired accidents including snagging on objects and tripping on lacing that becomes untied during use may result. Moreover, because of the dangers of the exposed lace of exterior-laced shoes becoming snagged on machinery and placing a user in dangerous positions, many companies forbid the use of these types of shoes in certain industrial applications. Additionally, the lacing of exterior-laced shoes is exposed to the shoes exterior environment and often results in premature wear.

Several attempts have been made to overcome some of these deficiencies. For instance, designs have been proposed wherein the lace system wraps around the heel portion of the shoe to provide a better means for securing the foot within the shoe. Examples of such designs may be found by reference to U.S. Pat. No. 5,775,006 to Breuner, U.S. Pat. No. 5,400,529 to Bell et al., U.S. Pat. No. 5,269,078 to Cochrane and U.S. Pat. No. 3,977,098 to Chalmers. However, these designs teach the use of heel lacing in boots and therein incorporate more complicated and/or bulky fastening means and thus, are not suitable for typical shoes, especially sporting shoes. Moreover, lacing systems that only wrap around the heel of the shoe do not provide maximum securing of the entire foot within the shoe.

In an attempt to solve some of the above-discussed deficiencies of exterior lacing, U.S. Pat. No. 5,269,078 to Cochrane discloses a partially internally laced shoe. However, the internal lacing only wraps around the heel of the shoe; traditional lacing is needed for the upper center of the shoe. Nonetheless, even with the dual lacing system, Cochrane fails to secure the entire foot within a shoe as adequately as provided by the present invention. Moreover, the exterior lacing of Cochrane remains susceptible to snagging and premature wear and tear.

An additional deficiency noted in previous designs is the need to utilize two hands to tie and/or secure the lacing in position. For many handicap individuals, traditional shoes can be difficult if not impossible to tie and/or adequately secure around the feet. Additionally, many professional and nonprofessional athletes and other users find it both interfering and time consuming to use both hands to retie traditional shoe lacing that may become easily untied during use. In an attempt to overcome these deficiencies designs have been proposed that allow one hand or finger tightening. An example of such a design may be found by reference to U.S. Pat. No. 4,130,949 to Seidel. Although Seidel discloses a one-pull tightening system, as with other previous deficient designs, Seidel's lacing system only tightens the upper center portion of the shoe and thus fails to adequately secure the entire foot within the shoe.

It is readily apparent that a new and improved internally laced shoe is needed that provides for a one-pull lacing system that wraps around the entire shoe and foot, including the heel, to provide means for more adequately securing the entire foot within the shoe. It is, therefore, to the provision of such improvements that the present invention is directed.

BRIEF SUMMARY OF THE INVENTION

Briefly described, in a preferred embodiment, the present invention overcomes the abovementioned disadvantages by providing an internally laced shoe that more fully secures the wearer's foot within the shoe.

The present invention, in a preferred embodiment, comprises a shoe, a plurality of lace guides, a buckle and lacing. More specifically, lace guides are positioned at a multitude of advantage points to maximize the tightening of the shoe around a wearer's foot. These advantage points in the preferred embodiment are along the upper center, bottom inside edge, bottom outside edge and heel of the shoe. Preferably two to eight lace guides are positioned along the bottom inside edge, two to eight along the bottom outside edge, two to eight along the upper center and one to three on the heel of the shoe. The lace is preferably one continuous generally elongated rectangular-shaped cloth, elastic or other flexible material having a first end and a second end.

The first end of the lace is sewn or otherwise secured internally near the toe of the shoe. The second end of the lace is channeled through each lace guide starting with the first bottom edge lace guide proximal to the first end of the lace, through the sole of the shoe and through the first bottom lace guide opposite the secured first end of the lace and then through the first lace guide of the upper center set. Next, the lace is channeled through the next adjacent bottom edge guide on the side of the shoe having the secured first end of the lace. This pattern is continued until the lace is channeled through the next to last (fifth) upper center lace guide, at which time the lace is wrapped around the heel of the shoe, through the heel lace guide, and back around through the last upper center lace guide. Upon exiting this last lace guide the second end of the lace is channeled through a fixed buckle and into a small slit positioned near the buckle to provide a means for hiding any excess lace. Alternatively or additionally, hook-and-loop fastener or other suitable securing means may be utilized to secure the lace in the desired position in lieu of the buckle. Preferably, the first, fourth and sixth upper center lace guides extend through apertures formed in the outside layer of the shoe and thus are the only externally visible lace guides. As such, the lace remains internal until it exits out of the sixth upper lace guide except for small portions that are externally visible near or at the first, fourth and sixth upper center lace guides.

Because of the strategically placed lace guides, a user simply pulls on the exposed second end of the lace thereby allowing the lace to roll along a roller positioned within each lace guide. Additionally, because the first end of the lace is fixed, the pulling on the second end of the lace will result in a reciprocating force about each lace guide thus securely tightening the shoe around the user's foot.

In a first alternate embodiment, an internal lacing system is disclosed wherein the lace guides are positioned internally in a generally diamond-shaped layout. There are preferably four lace guides each comprises preferably two rollers. The first lace guide is positioned generally in the upper centerline of the shoe near the toe area; the second lace guide is positioned generally on the left side of the shoe and in close proximity to the sole at approximately the middle of the shoe, lengthwise; the third lace guide is positioned generally on the right side of the shoe and in close proximity to the sole at approximately the middle of the shoe, lengthwise, and thus directly opposite the second lace guide; the fourth lace guide is positioned generally in the upper centerline of the shoe near the foot opening. The lace in this first alternate embodiment is generally two elongated cylindrical-shaped cords made from cloth or other flexible material. Each lace has a first end and a second end.

The first end of each lace is secured to a point or adjacent points, preferably, near the center of the diamond-shaped formation. The second end of one lace is first channeled through the third lace guide and over one of its rollers, then through the first lace guide and over one of its rollers, then through the second lace guide and over one of its rollers, then through the fourth lace guide and encircles one of its rollers, and then exits the interior of the shoe and is secured by a buckle positioned on the left side of the shoe near the fourth lace guide. The second end of the other lace is first channeled through the second lace guide and over its other roller, then through the first lace guide and over its other roller, then through the third lace guide and over its other roller, then through the fourth lace guide and encircles its other roller, and then exits the interior of the shoe and is secured by a buckle positioned on the right side of the shoe near the fourth lace guide.

Because of the strategically placed lace guides in the first alternate embodiment, a user simply pulls in opposite directions on the two exposed second ends of the two laces thereby allowing the laces to roll along the rollers positioned within each lace guide. Additionally, because the first ends of each lace is fixed, the pulling on the second ends of each lace will result in a reciprocating force about each lace guide thus securely tightening the shoe around the user's foot.

In a second alternate embodiment of the present invention, as with the preferred embodiment, lace guides are positioned along the upper center, bottom left edge, bottom right edge and heel of the shoe. However, with this embodiment, three lace guides are positioned along the lower left edge, two along the bottom right edge, six along the upper center and one on the heel of the shoe. An additional distinction from the preferred embodiment is that the lace is not channeled through the sole of the shoe; all of the lower left and lower right edge lace guides are positioned just above the sole of the shoe. The lace is preferably one continuous generally elongated rectangular-shaped cloth made from elastic or other flexible material having a first end and a second end.

The first end of the lace is sewn or otherwise secured internally near the toe of the shoe. The second end of the lace is channeled through each lace guide starting with the first bottom edge lace guide proximal to the first end of the lace and through the first lace guide of the upper center set. Next, the lace is channeled through the next adjacent bottom edge guide on the side of the shoe having the secured first end of the lace. This pattern is continued until the lace is channeled through the next to last (fifth) upper center lace guide, at which time the lace is wrapped around the heel of the shoe, through the heel lace guide, and back around through the last upper center lace guide. Upon exiting this last lace guide the second end of the lace is channeled through a fixed buckle and into a small slit positioned near the buckle to provide a means for hiding any excess lace. Alternatively or additionally, hook-and-loop fastener or other suitable securing means may be utilized to secure the lace in the desired position in lieu of the buckle. Preferably, the first, fourth and sixth upper center lace guides extend through apertures formed in the outside layer of the shoe and thus are the only externally visible lace guides. As such, the lace remains internal until it exits out of the sixth upper lace guide except for small portions that are externally visible near or at the first, fourth and sixth upper center lace guides.

The preferred embodiment of the present invention has many features and advantages, some of which are listed herein and are as follows. A new and improved internal lacing system that is channeled through a multitude of lace guides strategically positioned to more securely tighten a shoe around a user's foot. A new and improved internal lacing system that is channeled through the sole of the shoe around the foot and through the heel to provide a complete wrap-around securing means that is superior to prior art designs in securing the shoe around a user's foot. A new and improved internal lacing system that allows for one hand tightening. A new and improved internal lacing system wherein the lace is substantially internal to protect the lace from wear and tear and thus reducing or eliminating the need for replacement lacing. A new and improved internal lacing system wherein the lace is substantially internal to reduce the risks of unintentional snagging of the lace. A new and improved internal lacing system wherein the lace is substantially internal to enhance the exterior aesthetics of a shoe. A new and improved internally laced shoe having the abovementioned features and advantages, and additionally is lightweight and relatively inexpensive to manufacture. A new and improved internal lacing system comprising lace guides having a roller to facilitating the movement of the lace. A new and improved internally laced shoe having the abovementioned features and advantages, and wherein the lace is substantially internal to provide more exterior surface, as compared to traditional shoe designs, for aesthetic designs and/or added upper center support.

A first alternate embodiment has many features and advantages, some of which are listed herein and are as follows. A new and improved internal lacing system that is channeled through a multitude of lace guides strategically positioned to more securely tighten a shoe around a user's foot. A new and improved internal lacing system having lace guides positioned in generally a diamond formation. A new and improved internal lacing system comprising lace guides having dual rollers to facilitate the movement of the lace. A new and improved internal lacing system wherein the lace is substantially internal to protect the lace from wear and tear and thus reducing or eliminating the need for replacement lacing. A new and improved internal lacing system wherein the lace is substantially internal to reduce the risks of unintentional snagging of the lace. A new and improved internal lacing system wherein the lace is substantially internal to enhance the exterior aesthetics of a shoe. A new and improved internally laced shoe having the abovementioned features and advantages, and additionally is lightweight and relatively inexpensive to manufacture. A new and improved internally laced shoe having the abovementioned features and advantages, and wherein the lace is substantially internal to provide more exterior surface, as compared to traditional shoe designs, for aesthetic designs and/or added upper center support.

A second alternate embodiment has many features and advantages, some of which are listed herein and are as follows. A new and improved internal lacing system that allows for one hand tightening. A new and improved internal lacing system that is channeled through a multitude of lace guides strategically positioned to more securely tighten a shoe around a user's foot. A new and improved internal lacing system wherein the lace is substantially internal to protect the lace from wear and tear and thus reducing or eliminating the need for replacement lacing. A new and improved internal lacing system wherein the lace is substantially internal to reduce the risks of unintentional snagging of the lace. A new and improved internal lacing system comprising lace guides having a roller to facilitating the movement of the lace. A new and improved internal lacing system wherein the lace is substantially internal to enhance the exterior aesthetics of a shoe. A new and improved internally laced shoe having the abovementioned features and advantages, and additionally is lightweight and relatively inexpensive to manufacture. A new and improved internally laced shoe having the abovementioned features and advantages, and wherein the lace is substantially internal to provide more exterior surface, as compared to traditional shoe designs, for aesthetic designs and/or added upper center support.

These and other objects, features and advantages of the invention will become more apparent to one skilled in the art from the following description and claims when read in light of the accompanying drawings.

BRIEF DESCRIPTION OF THE FIGURES

FIG. 9 is a left side view of the right shoe of the present invention according to a first alternate embodiment.

FIG. 10 is a front view showing the lacing system of the present invention according to a first alternate embodiment.

FIG. 11 is a perspective view of a dual lace guide of the present invention according to a first alternate embodiment.

FIG. 12 is a perspective view of a single lace guide of the present invention according to a first alternate embodiment.

DETAILED DESCRIPTION OF THE PREFERRED AND ALTERNATE EMBODIMENTS

Figure 1:
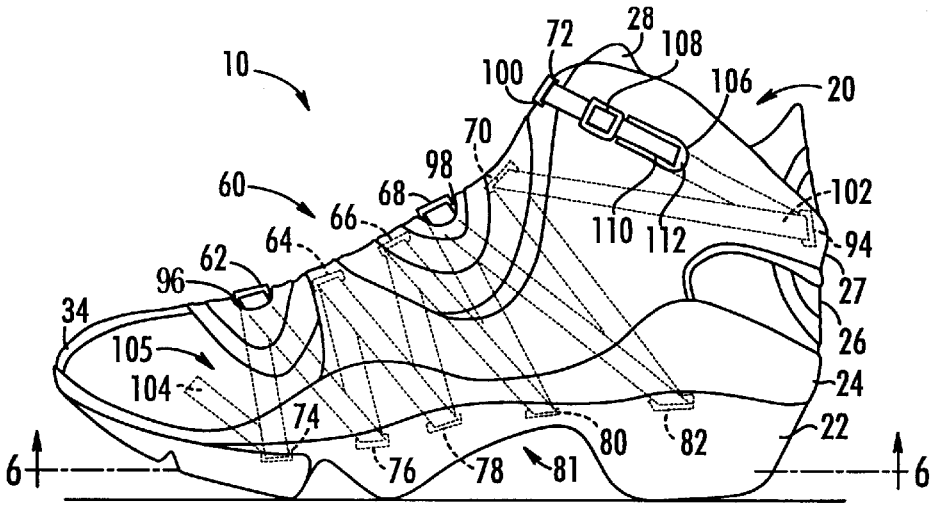
FIG. 1 is an inside edge view of the right shoe of the present invention according to a preferred embodiment.
Figure 2:
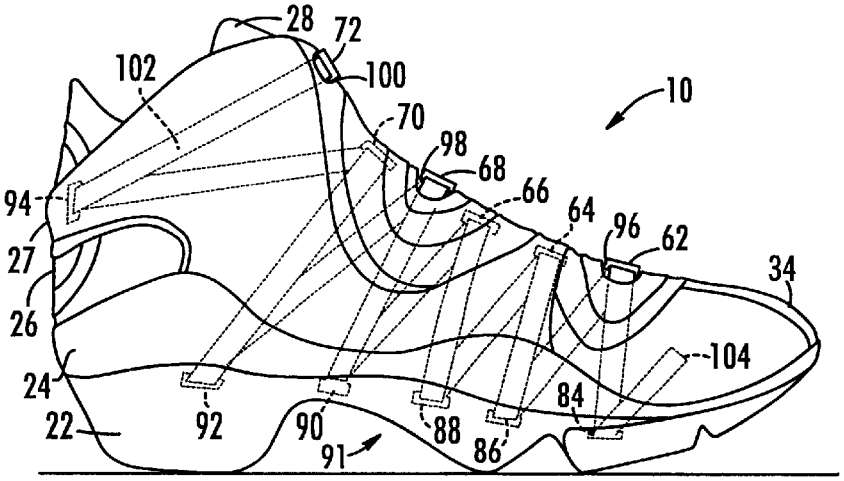
FIG. 2 is an outside edge view of the right shoe of the present invention according to a preferred embodiment.
Figure 3:
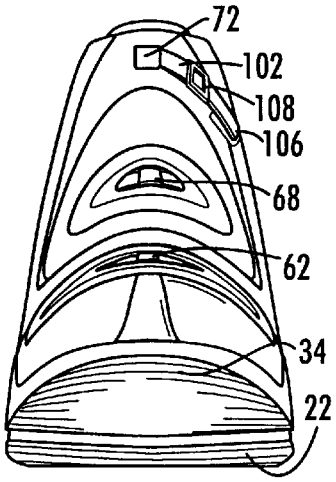
FIG. 3 is a front view of the present invention according to a preferred embodiment.
Figure 4:
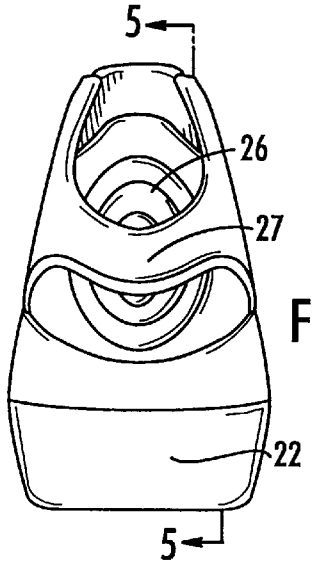
FIG. 4 is a rear view of the present invention according to a preferred embodiment.
Figure 5:
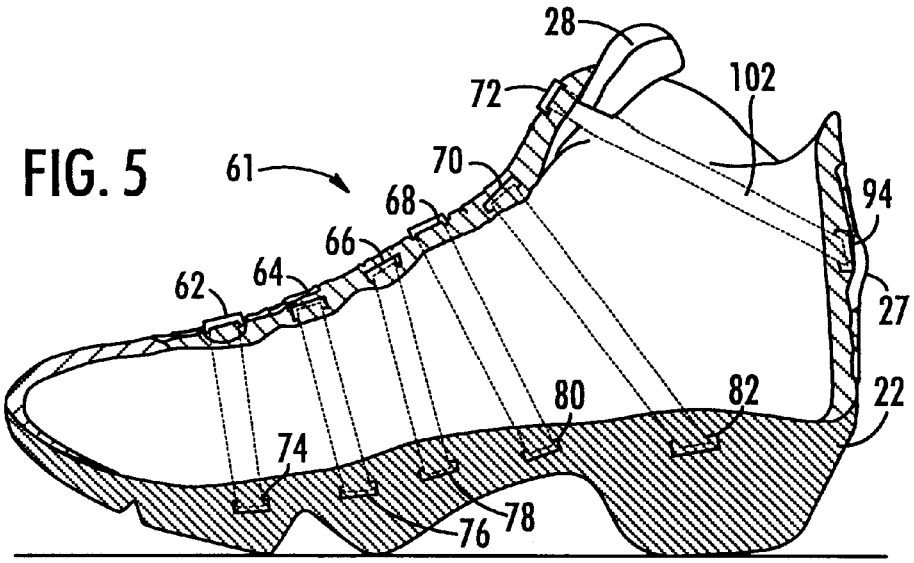
FIG. 5 is a sectional view along line 5—5 of FIG. 4 of the present invention according to a preferred embodiment.
Figure 6:
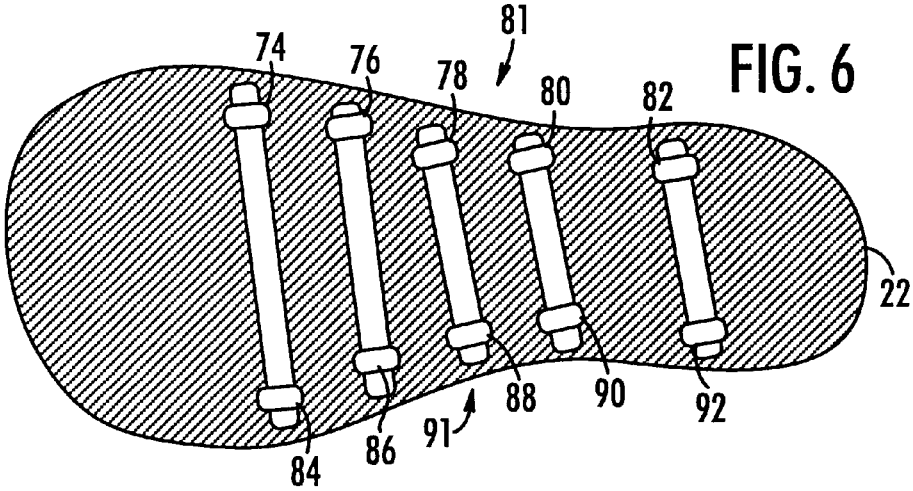
FIG. 6 is a sectional view along line 6—6 of FIG. 1 of the present invention according to a preferred embodiment.

Referring now to FIGS. 1–4, device 10 in a preferred embodiment generally comprises shoe 20, lacing guide system 60, lace 102 and buckle 108. More particularly, lacing guide system 60 preferably comprises a plurality of lace guides 62, 64, 66, 68, 70, 72, 74, 76, 78, 80, 82, 84, 86, 88, 90, 92, 94 positioned generally in three groups. Group A 61 comprises lace guides 62, 64, 66, 68, 70, 72 positioned generally near the top center of shoe 20 spaced apart along approximately a center line of tongue 28. Group B 81 comprises lace guides 74, 76, 78, 80, 82 positioned generally along the left side of shoe 20 in sole 22 and spaced horizontally apart. Group C 91 comprises lace guides 84, 86, 88, 90, 92 positioned generally along the right side of shoe 20 in sole 22 and spaced horizontally apart. An additional lace guide 94 is positioned generally near the center of heel 26. All lace guides except lace guides 62, 68 and 72 are internal and thus are not visible from the exterior of the shoe. Lace guides 62, 68, and 72 of Group A 61 protrude through apertures 96, 98 and 100, respectively, formed through the exterior layer of shoe 20.

Lace 102 is generally an elongated rectangular-shaped elastic, cloth or other flexible material having first end 104 and second end 106. First end 104 of lace 102 is fixably secured by sewing or other well known means to the internal portion of the shell of shoe 20, preferably near the toe portion of shoe 20 at location 105. Second end 106 of lace 102 is first channeled through adjacent lace guide 74, through sole 22 and through lace guide 84. Next, second end 106 of lace 102 is channeled up to and through lace guide 62 positioned on the upper center of shoe 20 and then down to and through lace guide 76. The above pattern is repeated until second end 106 of lace 102 has been channeled through remaining lace guides 86, 64, 78, 88, 66, 80, 90, 68, 82, 92 and 70, sequentially. After being channeled through lace guide 70, second end 106 of lace 102 internally wraps around heel 26, through lace guide 94 and around through lace guide 72. At lace guide 72, second end 106 of lace 102 exits the shoe and becomes exterior. Second end 106 of lace 102 is then channeled through and secured by buckle 108, wherein buckle 108 is secured to the exterior of shoe 20 proximal to lace guide 72. To receive and secure second end 106 of lace 102 is hook-and-loop fastener 112 positioned in close proximity to the exit side of buckle 108. Alternatively or in addition, slit 110 is formed in close proximity to the exit side of buckle 108 and is dimensioned for receiving second end 106 of lace 102 and any excess lace.

Figure 7:
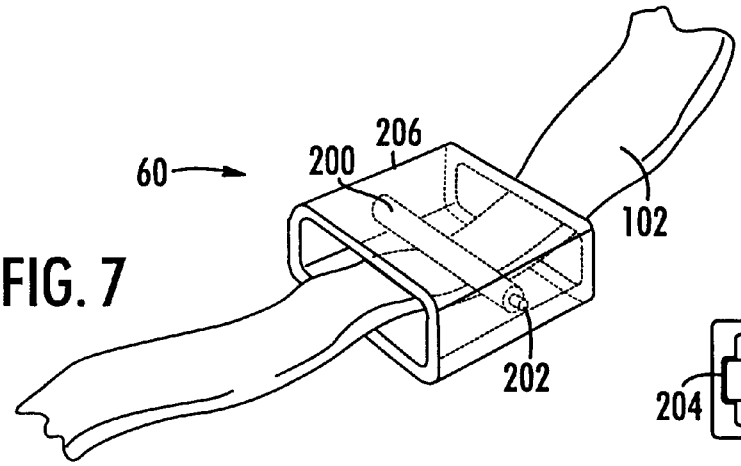
FIG. 7 is a perspective view of a lace guide according to a preferred embodiment.
Figure 8:
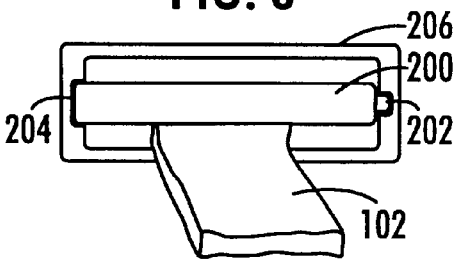
FIG. 8 is a sectional side view of a lace guide according to a preferred embodiment.

Now referring to FIGS. 7–8, each lace guide 62, 64, 66, 68, 70, 72, 74, 76, 78, 80, 82, 84, 86, 88, 90, 92, 94 comprises casing 206 and roller 200. Each roller 200 rotates about pin 206 which additionally serves to secure roller 200 within casing 206 by engaging an aperture or dimple within casing 206. Casing 206 is generally a four-sided rectangular box-like structure having two opposite opened ends. Each casing 206 is secured at the respective locations in shoe 20 by adhesive material, a securing strap extending through casing 206 and sewn to shoe 20, or by other well known means. Lace 102 extends through the opened ends and over or under roller 200. To allow lace 102 to rotate about the respective rollers 200, lace 102 is channeled over roller 200 in lace guides 62, 64, 66, 68, 70, 72 and 94, and is channeled under roller 200 in lace guides 74, 76, 78, 80, 82, 84, 86, 88, 90 and 92.

In use, because of the strategically placed lace guides 62, 64, 66, 68, 70, 72, 74, 76, 78, 80, 82, 84, 86, 88, 90, 92, 94, a user simply pulls on the exposed second end 106 of lace 102 thereby allowing the lace to roll along a roller positioned within each lace guide. Additionally, because the first end of the lace is fixed, the pulling on the second end of the lace will result in a reciprocating force about each lace guide thus tightening the shoe around the user's foot.

Referring now to FIGS. 9–11, first alternate embodiment 300 generally comprises shoe 320, lacing guide system 360, laces 310, 312 and buckles 362, 365. More particularly, lacing guide system 360 preferably comprises a plurality of dual lace guides 325, 330, 340, 350 positioned under the exterior layer of shoe 320 in generally a diamond-shaped formation. Lace guide 350 is positioned generally at the upper center of shoe 320 proximal to the exposed portion of tongue 328. Lace guide 330 is positioned generally at the upper center of shoe 320 proximal to toe area 334. Lace guide 325 is positioned generally on the left side of shoe 320 proximal to sole 322 and more specifically, in approximately the same vertical plane as lace guide 350. Lace guide 340 is positioned generally on the right side of shoe 320 proximal to sole 322 and more specifically, in approximately the same vertical plane as lace guide 350.

Lace guide 325 comprises casing 327 and rollers 322, 324. Rollers 322 and 324 rotate about pins 326 and 328, respectively, which additionally serve to secure rollers 322, 324 within casing 327 by engaging an aperture or dimple within casing 327. Note that lace guides 330, 340, 350 are identical to lace guide 325. Casing 327 is generally a four-sided rectangular box-like structure having two opposite opened ends. Each casing 327 is secured at the respective locations in shoe 320 by adhesive material, a securing strap extending through casing 327 and sewn to shoe 320, or by other well known means.

First end 314 of second lace 312 is sewn or otherwise secured at point 370 located generally near the upper center of shoe 320, and second end 390 of second lace 312 first is channeled through the opened ends of lace guide 325 and over roller 322. Next, second end 390 of second lace 312 is channeled through the open ends of lace guide 330 and over roller 332, and then channeled through the open ends of lace guide 340 and over roller 342. Second end 390 of second lace 312 is then channeled into the right side opening of lace guide 350, around roller 352, back out the right side opening and secured through buckle 362. Second end 390 of second lace 312 and any excess is inserted through slit 392 formed adjacent to buckle 362. First end 316 of first lace 310 is sewn or otherwise secured at point 372 located generally near the upper center of shoe 320, and second end 380 of first lace 310 first is channeled through the opened ends of lace guide 340 and over roller 344. Next, second end 380 of first lace 310 is channeled through the open ends of lace guide 330 and over roller 336, and then channeled through the open ends of lace guide 325 and over roller 324. Second end 380 of first lace 310 is then channeled into the left side opening of lace guide 350, around roller 354, back out the right side opening and secured through buckle 365. Second end 380 of first lace 310 and any excess is inserted through slit 382 formed adjacent to buckle 365.

In use, because of the strategically placed lace guides 325, 330, 340, 350, a user simply pulls on the exposed second end 380 of first lace 310 generally to the left and the exposed second end 390 of second lace 312 generally to the right, thereby allowing the laces to roll along a roller positioned within each lace guide. Additionally, because the first end of the lace is fixed, the pulling on the second end of the lace will result in a reciprocating force about each lace guide thus tightening the shoe around the user's foot.

Figure 13:
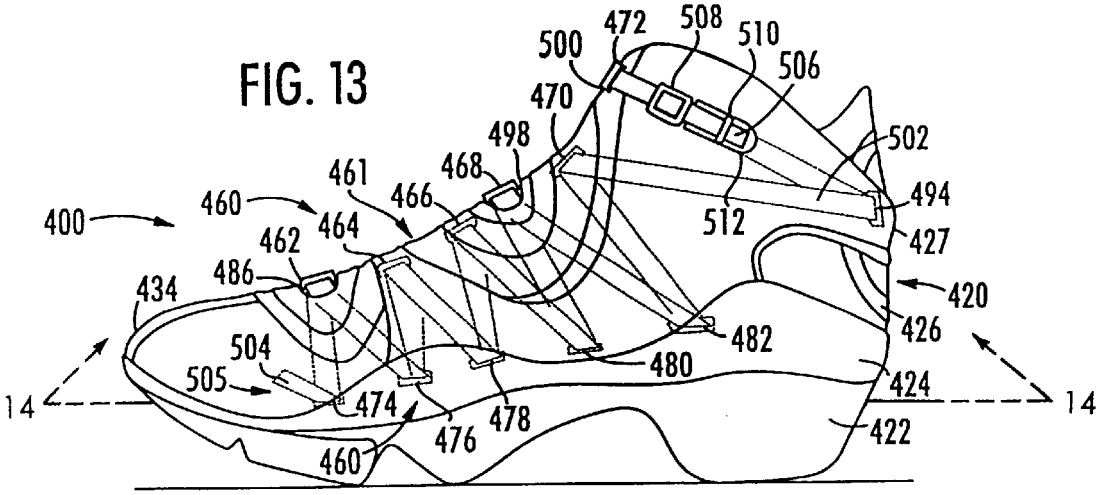
FIG. 13 is an inside edge view of the right shoe of the present invention according to a second alternate embodiment.
Figure 14:
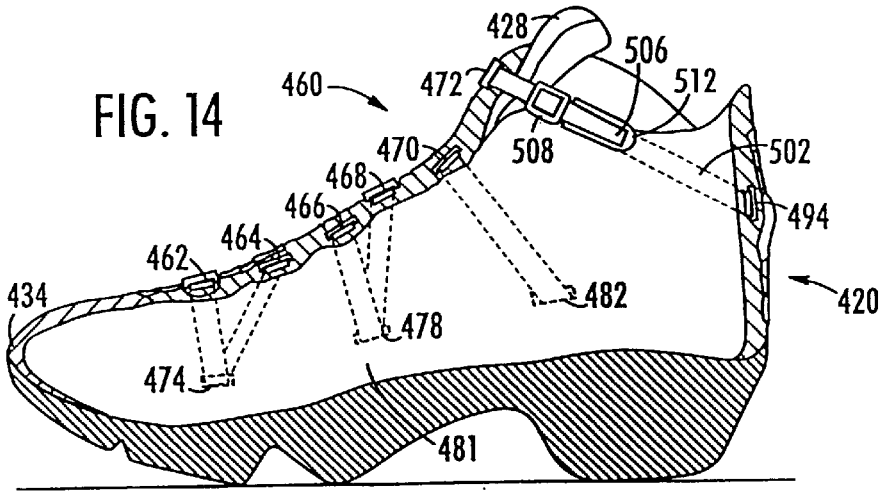
FIG. 14 is a sectional view along line 14—14 of FIG. 13 of the present invention according to a second alternate embodiment.
Figure 15:
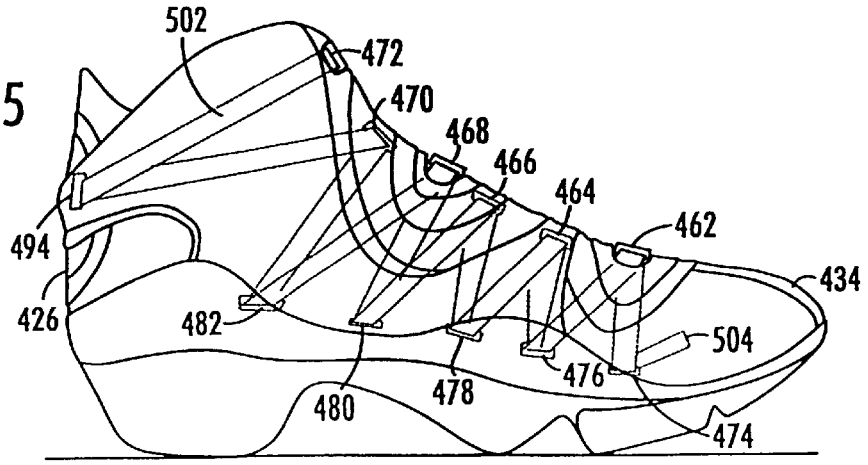
FIG. 15 is an outside edge view of the right shoe of the present invention according to a second alternate embodiment.
Figure 16:
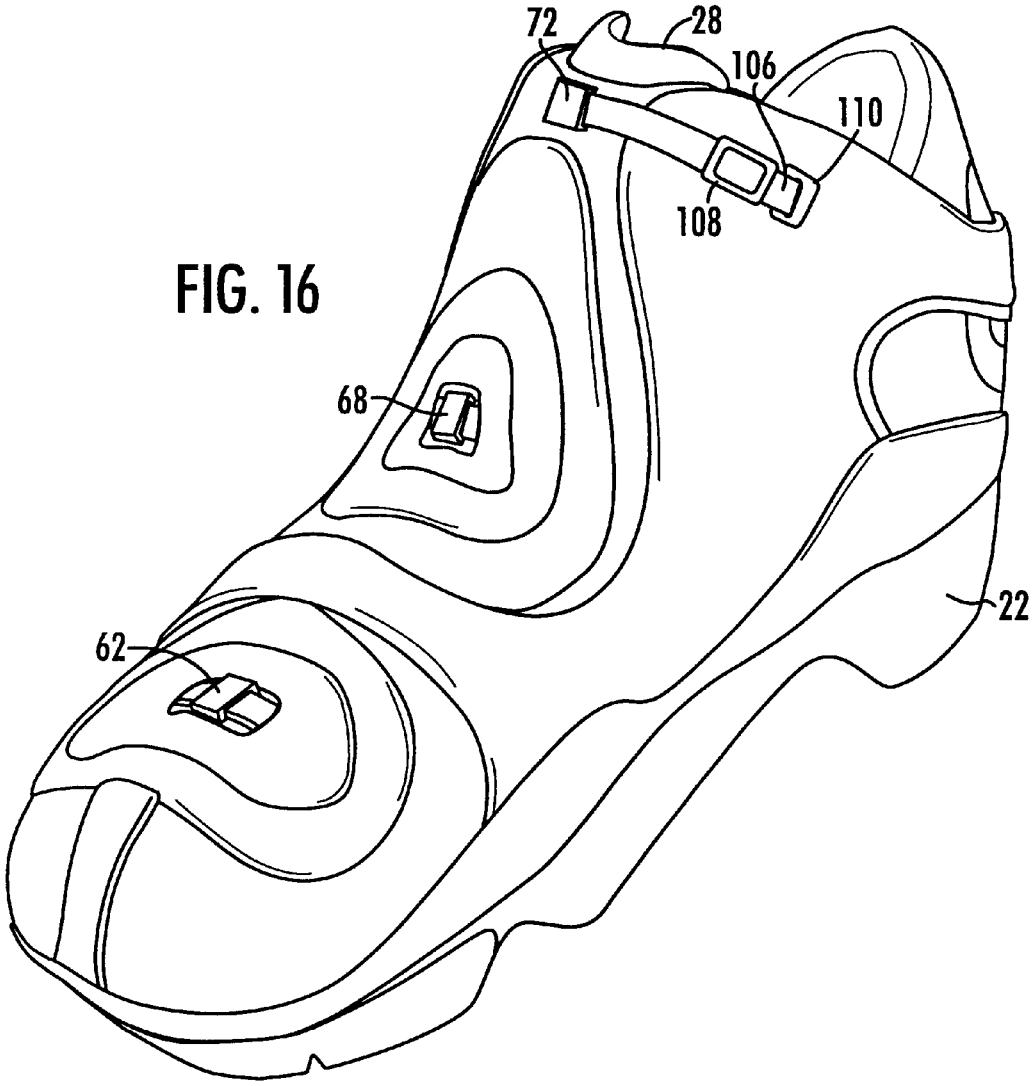
FIG. 16 is a perspective view of the present invention according to a preferred embodiment or a second alternate embodiment.

Referring now to FIGS. 13–15, second alternate embodiment 400 generally comprises shoe 420, lacing guide system 460, lace 502 and buckle 508. More particularly, lacing guide system 460 preferably comprises a plurality of lace guides 462, 464, 466, 468, 470, 472, 474, 476, 478, 480, 482, 494 positioned generally in three groups. Group A 461 comprises lace guides 462, 464, 466, 468, 470, 472 positioned generally near the top center of shoe 420 spaced apart along approximately a center line of tongue 428. Group B 481 comprises lace guides 474, 478, 482 positioned generally internally along the left side of shoe 420 in close proximity to sole 422 and spaced horizontally apart. Group C 491 comprises lace guides 476, 480 positioned generally along the right side of shoe 420 in close proximity to sole 422 and spaced horizontally apart, wherein lace guide 476 is generally positioned horizontally between lace guide 474 and lace guide 478 on the opposite side of shoe 420, and wherein lace guide 480 is generally positioned horizontally between lace guide 478 and lace guide 482 on the opposite side of shoe 420. An additional lace guide 494 is positioned generally near the center of heel 426. All lace guides except lace guides 462, 468 and 472 are internal and thus are not visible from the exterior of the shoe. Lace guides 462, 468, and 472 of Group A 461 protrude through apertures 496, 498 and 500, respectively, formed through the exterior layer of shoe 420.

Lace 502 is generally an elongated rectangular-shaped material made from elastic, cloth or other flexible material having first end 504 and second end 506. First end 504 of lace 502 is fixably secured by sewing or other well known means to the internal portion of the shell of shoe 420, preferably near the toe portion of shoe 420 at location 505. Second end 506 of lace 502 is first channeled through adjacent lace guide 474, up to and through lace guide 462, down and over to and through lace guide 476. Next, second end 506 of lace 502 is channeled up to and through lace guide 464 positioned on the upper center of shoe 420 and then down and over to and through lace guide 478. The above pattern is repeated until second end 506 of lace 502 has been channeled through remaining lace guides 466, 480, 468, 482, and 470, sequentially. After lace guide 470, second end 506 of lace 502 internally wraps around heel 426, through lace guide 494 and around through lace guide 472. At lace guide 472, second end 506 of lace 502 exits shoe 420 and becomes exterior thereto. Second end 506 of lace 502 is then channeled through and secured by buckle 508, wherein buckle 508 is secured to the exterior of shoe 420 proximal to lace guide 472. To receive and secure second end 506 of lace 502 is hook-and-loop fastener 512 positioned in close proximity to the exit side of buckle 508. Alternatively or in addition, slit 510 is formed in close proximity to the exit side of buckle 508 and is dimensioned for receiving second end 506 of lace 502 and any excess lace.

The lace guides described above for the preferred embodiment and as shown in FIGS. 7–8, are the same lace guides utilized for this second alternate embodiment.

In use, because of the strategically placed lace guides 462, 464, 466, 468, 470, 472, 474, 476, 478, 480, 482, 494, a user simply pulls on the exposed second end 506 of lace 502 thereby allowing the lace to roll along a roller positioned within each lace guide. Additionally, because the first end of the lace is fixed, the pulling on the second end of the lace will result in a reciprocating force about each lace guide thus tightening the shoe around the user's foot.

The above detailed description of a preferred embodiment or alternate embodiments are for exemplary purposes only and are not meant to limit the scope or spirit of the invention as defined by the appended claims.

What is claimed is:

1. An internally laced shoe having a sole, an upper portion, a toe portion, a first side, a second side, and a heel portion, comprising:

at least one lace having a first end and a second free end, said first end of said lace secured within said shoe proximal to said toe portion, said lace extended substantially internally at least from said first side across said upper portion to said second side and from said second side across said upper portion to said first side, said second end of said lace extended to the exterior of said shoe, exiting the internal of said shoe proximal to said upper portion;

guide means carried internally by said shoe for slidably engaging and guiding said lace; and means carried by said shoe for adjustably securing said second end of said lace, wherein when said second end of said lace is pulled, said lace slides about said guide means producing a reciprocating force about said guide means and thus, tightening said shoe around a foot, and wherein said second end of said lace is pullable by hand.

2. The device of claim 1, wherein said guide means is a plurality of members each having an aperture therethrough for receiving said lace, and a roller rotatably engaged within each of said members, wherein said lace engages said roller and slides about said roller when said lace moves.

3. The device of claim 1, wherein said securing means is a buckle.

4. The device of claim 1, wherein said securing means is hook and loop fastener.

5. The device of claim 1, further comprising a plurality of channels formed within said sole of said shoe and wherein at least one of said guide means is positioned in each of said plurality of channels.

6. The device of claim 1, wherein said guide means are positioned in generally a diamond-shaped formation about said shoe.

7. The device of claim 1, wherein at least one of said guide means is positioned at the heel of said shoe.

* * * * *